US011834870B2

(12) United States Patent
Nam et al.

(10) Patent No.: US 11,834,870 B2
(45) Date of Patent: Dec. 5, 2023

(54) MOTOR-DRIVEN DOOR LATCH FOR VEHICLE

(71) Applicants: Hyundai Motor Company, Seoul (KR); Kia Motors Corporation, Seoul (KR)

(72) Inventors: Jinwoo Nam, Seoul (KR); Kyoung Taek Kwak, Yongin-si (KR); Jungho Han, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 534 days.

(21) Appl. No.: 16/441,995

(22) Filed: Jun. 14, 2019

(65) Prior Publication Data

US 2020/0263458 A1 Aug. 20, 2020

(30) Foreign Application Priority Data

Feb. 19, 2019 (KR) ..... 10-2019-0019247

(51) Int. Cl.
*E05B 81/16* (2014.01)
*E05B 81/34* (2014.01)
(Continued)

(52) U.S. Cl.
CPC ..... *E05B 81/16* (2013.01); *E05B 81/34* (2013.01); *E05B 81/36* (2013.01); *E05B 81/76* (2013.01);
(Continued)

(58) Field of Classification Search
CPC ..... Y10S 292/23; E05B 81/06; E05B 81/14; E05B 81/16; E05B 81/20; E05B 81/34;
(Continued)

(56) References Cited

U.S. PATENT DOCUMENTS 4,763,936 A * 8/1988 Rogakos ..... E05B 81/20 292/216
4,806,712 A * 2/1989 Hoffman ..... E05B 81/66 292/216
(Continued)

FOREIGN PATENT DOCUMENTS

CA 2425857 A1 * 10/2003 ..... E05B 81/14
CN 105358785 A 2/2016
(Continued)

OTHER PUBLICATIONS

Annotated machine translation of EP 0095983 A1 (Year: 1983).*

*Primary Examiner* — Christine M Mills
*Assistant Examiner* — Peter H Watson
(74) *Attorney, Agent, or Firm* — Slater Matsil, LLP

(57) ABSTRACT

A motor-driven door latch for a vehicle includes a catch part which is caught on a striker mounted on the vehicle to lock a door for a vehicle to a vehicle body or is released from the striker so that the door can be opened from the vehicle body; a door locking and releasing part which includes a main motor and applies torque to the catch part through the main motor to allow the catch part to be locked to or released from the striker; and a pop-up part including an auxiliary motor and applying torque to the catch part so that the door for the vehicle is popped up from a vehicle body, so that the door for the vehicle is popped up from a vehicle body after the door for the vehicle is released from vehicle body.

18 Claims, 7 Drawing Sheets

(51) Int. Cl.
*E05B 85/24* (2014.01)
*E05B 81/76* (2014.01)
*E05B 81/36* (2014.01)

(52) U.S. Cl.
CPC ..... *E05B 85/243* (2013.01); *E05Y 2900/531* (2013.01)

(58) Field of Classification Search
CPC ..... E05B 81/36; E05B 81/76; E05B 81/90; E05B 85/01; E05B 85/143; E05B 85/26; E05B 77/34; E05B 77/30; E05B 77/16; E05B 77/12; E05B 79/20; E05B 85/243; E05B 81/18; E05B 83/16; E05B 83/18; E05B 83/24; Y10T 292/1047; Y10T 292/1082; Y10T 292/1079; Y10T 292/308
USPC ..... 49/364, 503
See application file for complete search history.

(56) References Cited

U.S. PATENT DOCUMENTS 5,918,917 A * 7/1999 Elton ..... E05B 81/20 292/201
6,439,623 B1 * 8/2002 Lohfeld ..... E05B 81/20 292/216
10,087,671 B2 10/2018 Linden et al.
2007/0210588 A1 9/2007 Cetnar
2011/0214460 A1 * 9/2011 Byun ..... E05B 81/00 70/91
2014/0175809 A1 * 6/2014 Takeuchi ..... E05B 81/36 292/96
2016/0369551 A1 12/2016 Suzuki et al.
2017/0253281 A1 9/2017 Kwak et al.
2018/0066458 A1 3/2018 Ishiguro et al.
2018/0073287 A1 3/2018 Reddmann
2018/0223568 A1 8/2018 Cho et al.

FOREIGN PATENT DOCUMENTS

CN 107152208 A 9/2017
CN 107429526 A 12/2017
CN 107476683 A 12/2017
CN 107687299 A 2/2018
CN 207063744 U 3/2018
CN 108487801 A * 9/2018 ..... E05B 81/20
EP 0095983 A1 * 12/1983 ..... E05B 81/06
EP 0978610 A1 * 2/2000 ..... E05B 81/14
FR 2919647 A1 * 2/2009 ..... E05B 81/14
WO WO-2005026475 A2 * 3/2005 ..... E05B 17/0029

* cited by examiner

MOTOR-DRIVEN DOOR LATCH FOR VEHICLE

CROSS-REFERENCE TO RELATED APPLICATIONS

This application claims priority to Korean Patent Application No. 10-2019-0019247, filed in the Korean Intellectual Property Office on Feb. 19, 2019, which application is hereby incorporated herein by reference.

TECHNICAL FIELD

The present invention relates to a motor-driven door latch for a vehicle.

BACKGROUND

Generally, a motor-driven door latch for a vehicle is used to lock or unlock a door to a vehicle body by using a motor for the convenience of the user.

In addition, an inside handle and an outside handle are respectively installed to allow the user to grasp the vehicle door and to easily operate the vehicle door, and a switch or the like is provided on the vehicle door for locking or releasing the motor-driven door latch.

However, in the conventional motor-driven door latch structure, in order to open the door for vehicle from the outside, it needs an outside handle so that a passenger can easily grip the door for vehicle by hand, and the outside handle is mounted on the outside panel of the door for vehicle to protrude outside in a width direction of the vehicle or to be accommodated in the outside panel, which deteriorates the outer appearance of the vehicle and causes a driving resistance.

The above information disclosed in this Background section is only for enhancement of understanding of the background of the invention and therefore it may contain information that does not form the prior art that is already known in this country to a person of ordinary skill in the art.

SUMMARY

The present invention relates to a motor-driven door latch for a vehicle. Particular embodiments of the present invention relate to a motor-driven door latch for a vehicle in which a door for a vehicle can be popped out from a vehicle body after the door for the vehicle is released from the vehicle body.

Embodiments can provide a motor-driven door latch for a vehicle capable of improving appearance and marketability of the vehicle since it is not necessary to provide a separate gripping mechanism such as an outside handle, by allowing the door for the vehicle to pop out from the vehicle body when the door for the vehicle is opened so that the passenger can easily open the door for the vehicle popped out by hand.

A motor-driven door latch for a vehicle according to an exemplary embodiment of the present invention may include, a catch part which is caught on a striker mounted on the vehicle to lock a door for a vehicle to a vehicle body or is released from the striker so that the door can be opened from the vehicle body. A door locking and releasing part includes a main motor and applies torque to the catch part through the main motor to allow the catch part to be locked to or released from the striker. A pop-out part includes an auxiliary motor and applies torque to the catch part so that the door for the vehicle is popped out from a vehicle body.

The catch part may comprise a catch having a locking groove which the striker mounted on the vehicle body is catch in or separated from and being installed to be rotatable and a pawl installed to be rotatable and in close contact with the catch to limit the rotation of the catch or separated from the catch to allow the catch to be freely rotatable.

The door locking and releasing part may comprise the main motor, which can rotates in a clockwise and anticlockwise directions and includes a first drive gear, a first driven gear engaged with the first drive gear, a pawl release lever coupled to the pawl to be integrally rotated, and an operating lever, which is engaged with the first driven gear and receives the torque through the first driven gear to rotate the pawl release lever.

The pop-out part may comprise the auxiliary motor including a second drive gear, a second driven gear engaged with the second drive gear, and a third driven gear engaged with the second driven gear and simultaneously engaged with the catch gear.

Two seating protrusions may be formed at the pawl release lever and a pressurizing protrusion which seats on the seating protrusions and presses and rotates the pawl release lever may be provided at the operating lever.

A door latch controller detecting an operation of a handle or a button installed at the door for the vehicle and applying an operation signal to the main motor may be further included. The door latch controller may apply an operation signal to the auxiliary motor after the main motor is operated.

In accordance with the motor-driven door latch for a vehicle according to an exemplary embodiment of the present invention, since a door for a vehicle can be locked a vehicle body in a stable manner by using a main motor and the locked door can be freely released from the vehicle body, the user can conveniently use a door for a vehicle.

Also, after the door for the vehicle is released from the vehicle body, the door for the vehicle is popped out from the vehicle body to rotate toward the user using the auxiliary motor, so that the user can hold the door of the vehicle popped out by hand and open the door, it is possible to reduce the number of parts and weight and improve the appearance and marketability of the vehicle by eliminating the need for a separate mechanism or structure such as a conventional outside handle.

BRIEF DESCRIPTION OF THE DRAWINGS

These drawings are for reference purposes only and are not to be construed as limiting the technical idea of the present invention to the accompanying drawings.

Figure 1:
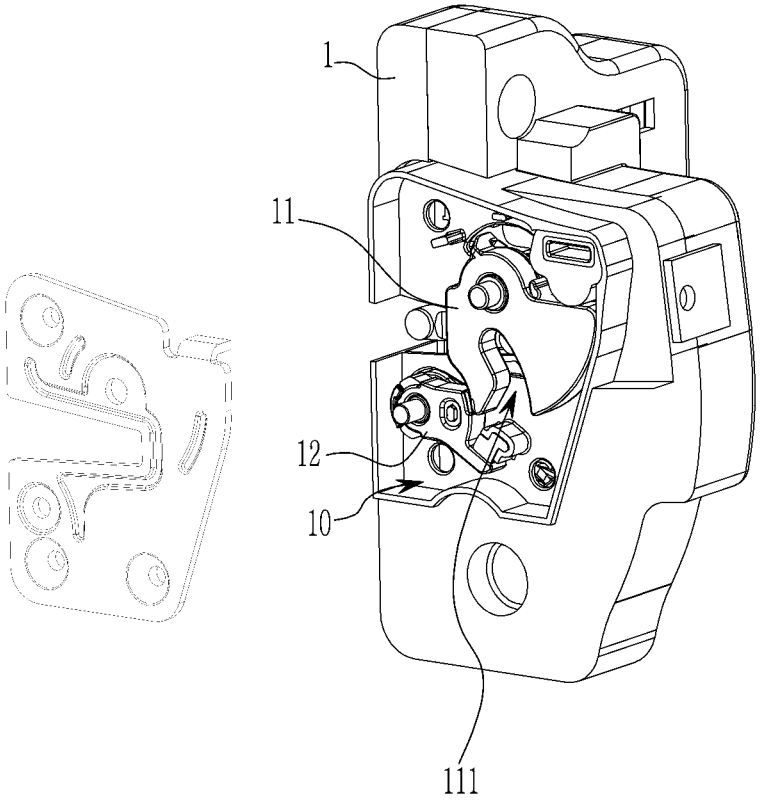
FIG. 1 is a side view of a motor-driven door latch for a vehicle according to an exemplary embodiment of the present invention.
Figure 2:
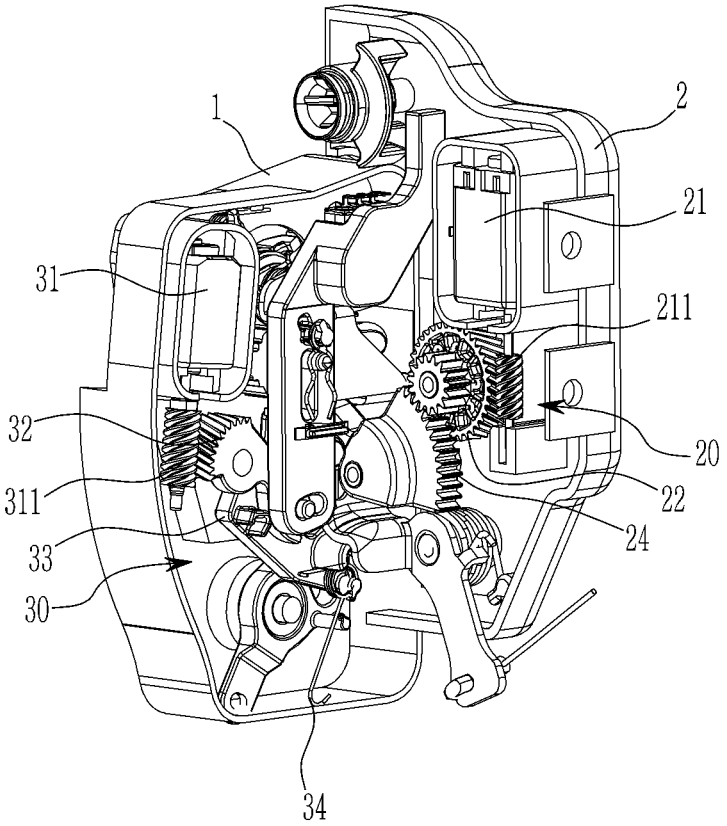
FIG. 2 is a front view of the motor-driven door latch for the vehicle according to an exemplary embodiment of the present invention.
Figure 3:
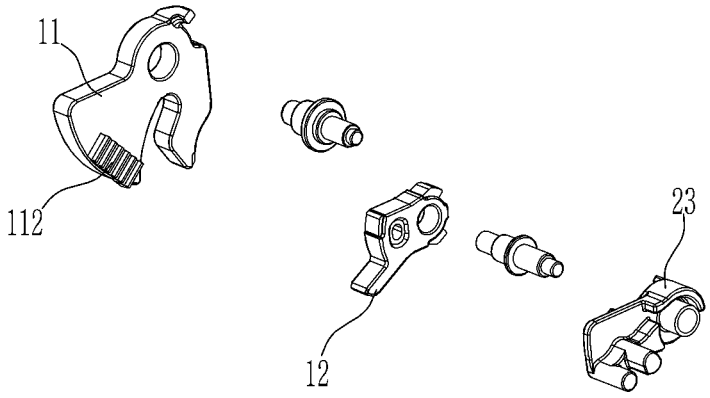
FIG. 3 is an exploded perspective view of a catch part of the motor-driven door latch for the vehicle according to an exemplary embodiment of the present invention.
Figure 4:
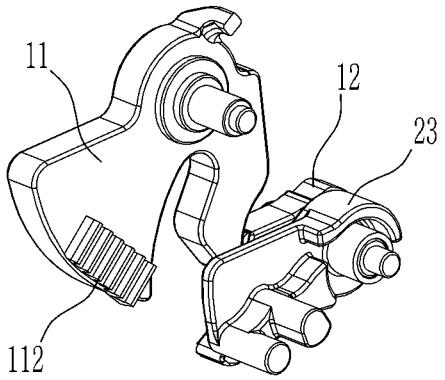
FIG. 4 is a perspective view showing coupling state of a pawl and a pawl release lever of the motor-driven door latch for the vehicle according to an exemplary embodiment of the present invention.
Figure 5:
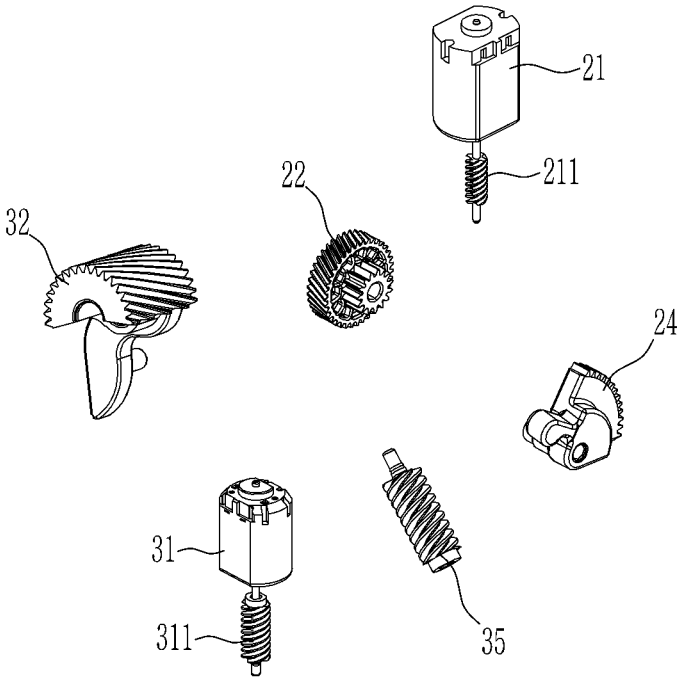
FIG. 5 is an exploded perspective view of a door locking and releasing part and a pop-out part of the motor-driven door latch for the vehicle according to an exemplary embodiment of the present invention.

The following reference symbols can be used in conjunction with the drawings:

1: first base plate
2: second base plate
10: catch part
11: catch
12: pawl
20: door locking and releasing part
21: main motor
22: first driven gear
23: pawl release lever
24: operating lever
30: pop-out part
31: auxiliary motor
32: second driven gear
35: third driven gear

DETAILED DESCRIPTION OF ILLUSTRATIVE EMBODIMENTS

The present invention will be described more fully hereinafter with reference to the accompanying drawings, in which exemplary embodiments of the invention are shown.

As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Since size and thickness of each component illustrated in the drawings are arbitrarily represented for convenience in explanation, the present invention is not particularly limited to the illustrated size and thickness of each component and the thickness is enlarged and illustrated in order to clearly express various parts and areas.

In the following description, dividing names of components into first, second and the like is to divide the names because the names of the components are the same as each other and an order thereof is not particularly limited.

Throughout the specification, unless explicitly described to the contrary, the word "comprise" and variations such as "comprises" or "comprising", will be understood to imply the inclusion of stated elements but not the exclusion of any other elements.

Referring to FIGS. 1 to 5, a motor-driven door latch for a vehicle according to an exemplary embodiment of the present invention may include, a catch part 10 which is caught on a striker mounted on the vehicle to lock a door for a vehicle to the vehicle body or is released from the striker so that the door can be opened from the vehicle body; a door locking and releasing part 20 which applies torque to the catch part 10 to allow the catch part 10 to be locked to or released from the striker; and a pop-out part 3*o* applying torque to the catch part 10 to pop out the door for the vehicle from vehicle body after the door for the vehicle is released from the vehicle body by the door locking and releasing part 20.

The catch part 10 may include a catch 11, which is rotatably mounted on one side of a first base plate 1 and has a locking groove 111 which the striker mounted on the vehicle body is inserted into or separated from and a catch gear 112 formed at one side thereof; and a pawl 12, which is mounted on the first base plate 1 to be rotatable and is in close contact with the catch 11 to limit the rotation of the catch 11 or separated from the catch 11 to allow the catch 11 to be freely rotatable.

The door locking and releasing part 20 may include a main motor 21, which is mounted on a second base plate 2, rotatable in a clockwise and anticlockwise directions, and includes a first drive gear 211; a first driven gear 22 engaged with the first drive gear 211; a pawl release lever 23 which is disposed with the first base plate 1 interposed therebetween and coupled to the pawl 12 to be integrally rotated (referring to FIG. 4); and an operating lever 24, which is engaged with the first driven gear 22 and rotates while receiving a torque from the first driven gear 22 to rotate the pawl release lever 23.

The pop-out part 3*o* may include an auxiliary motor 31 mounted on the first base plate 1 and provided with a second drive gear 311; a second driven gear 32 engaged with the second drive gear 311; and a third driven gear 35 engaged with the second driven gear 32 and simultaneously engaged with the catch gear 112.

When the user operates a release handle or a button mounted on the door, a door latch controller detects this to apply an operation signal to the main motor 21 to operate the main motor 21.

Figure 6:
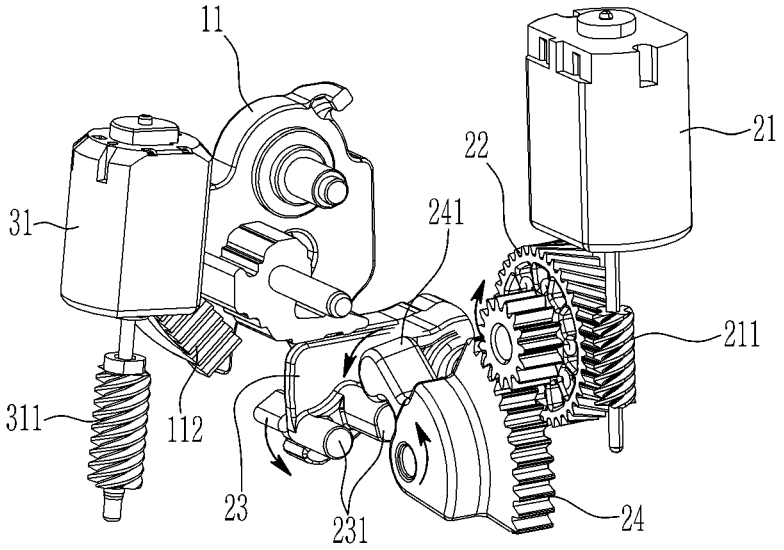
FIG. 6 is an operational explanatory diagram of the door locking and releasing part of the motor-driven door latch for the vehicle according to an exemplary embodiment of the present invention.

Referring to FIG. 6, the first drive gear 211 and the first driven gear 22 rotate respectively by driving the main motor 21, the operating lever 24 engaged with the first driven gear 22 is rotated to rotate the pawl release lever 23, and the pawl 12 rotates together by the rotation of the pawl release lever 23 and is spaced from the catch 11, so that the catch 11 can freely rotate, which allows the door locked to the vehicle body to be released.

The pawl release lever 23 may be provided with two seating protrusions 231 and the operating lever 24 may be provided with a pressurizing protrusion 241 which is seated on the seating protrusions 231 to press and rotate the pawl release lever 23.

Further, the door latch controller applies an operation signal to the auxiliary motor 31 to drive it.

Figure 7:
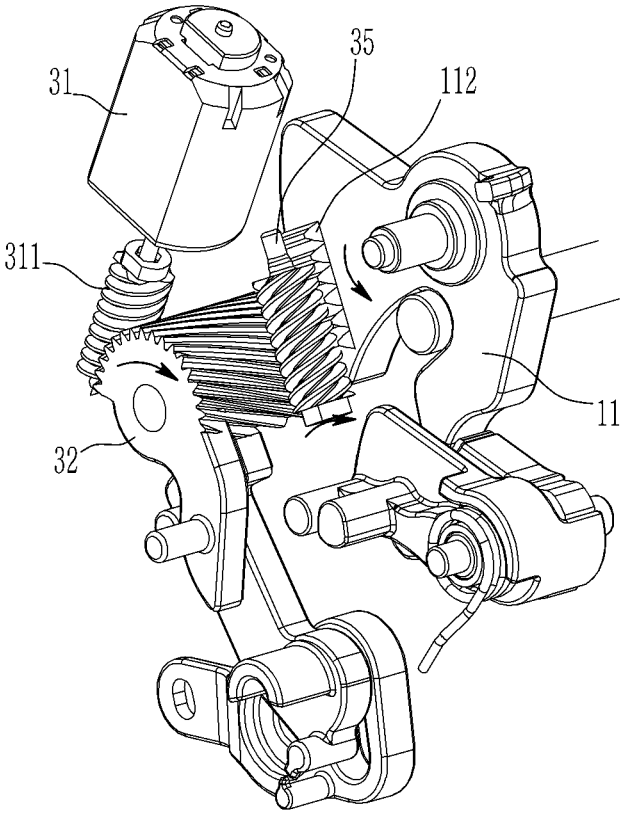
FIG. 7 is an operational explanatory diagram of the pop-out part of the motor-driven door latch for the vehicle according to an exemplary embodiment of the present invention.

Then, as shown in FIG. 7, the second drive gear 311, the second driven gear 32 and third driven gear 35 rotates sequentially, the torque of the third driven gear 35 is transmitted to the catch gear 112 so that the catch 11 is forcibly rotated, which causes the door for the vehicle released from the vehicle body is popped out from the vehicle body.

Therefore, since the passenger can hold the door for the vehicle popped out by hand and easily open the door, there is no need to mount a conventional outside handle and associated parts to the door for the vehicle, so that it is possible to reduce the number of parts, weight and cost and improve an appearance and marketability of the vehicle.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A motor-driven door latch for a vehicle having a vehicle body, the motor-driven door latch comprising:

a catch part configured to catch a striker mounted on the vehicle body;

a door locking and releasing part including a main motor and configured to apply torque to the catch part through the main motor to allow the catch part to be locked to or released from the striker; and a pop-out part including an auxiliary motor configured to apply torque to the catch part so that a door of the vehicle is popped out from the vehicle body after the catch part is released from the striker, wherein the catch part comprises:

a catch having a locking groove configured to catch or release the striker and a catch gear integrally formed on one side of the catch, the catch and the catch gear fixed together and rotatably movable, and a pawl configured to:

limit a rotation of the catch when in close contact with the catch, or allow the catch to be freely rotatable, wherein the door locking and releasing part comprises:

the main motor configured to rotate in a clockwise direction and an anticlockwise direction, the main motor comprising:

a first drive gear, a first driven gear engaged with the first drive gear, a pawl release lever coupled to the pawl and configured to be rotated together with the pawl, and an operating lever engaged with the first driven gear and configured to:

receive the torque through the first driven gear, and rotate the pawl release lever in order to bring the pawl in close contact with the catch or separate it from the catch, wherein the auxiliary motor includes a second drive gear configured to apply the torque to the catch through a gear mechanism of the pop-out part between the second drive gear and the catch gear integrally formed on the catch, and wherein the gear mechanism of the pop-out part comprises:

a second driven gear engaged with the second drive gear, and a third driven gear engaged with the second driven gear and simultaneously engaged with the catch gear of the catch.

2. The motor-driven door latch of claim 1, further comprising:

two seating protrusions formed at the pawl release lever; and a pressurizing protrusion provided at the operating lever, wherein the pressurizing protrusion is seated on the seating protrusions and is configured to press and rotate the pawl release lever.

3. The motor-driven door latch of claim 2, further comprising a door latch controller configured to detect an operation of a handle or a button installed at the door for the vehicle and to apply an operation signal to the main motor.

4. The motor-driven door latch of claim 3, wherein the door latch controller is configured to apply the operation signal to the auxiliary motor after the main motor is operated.

5. The motor-driven door latch of claim 1, further comprising a door latch controller configured to detect an operation of a handle or a button installed at the door for the vehicle and to apply an operation signal to the main motor.

6. The motor-driven door latch of claim 5, wherein the door latch controller is configured to apply the operation signal to the auxiliary motor after the main motor is operated.

7. A vehicle comprising:

a vehicle body;

a vehicle door attached to the vehicle body;

a striker mounted on the vehicle body;

a catch part configured to catch the striker;

a door locking and releasing part including a main motor and configured to apply torque to the catch part through the main motor to allow the catch part to be locked to or released from the striker; and a pop-out part including an auxiliary motor configured to apply torque to the catch part so that the vehicle door is popped out from the vehicle body after the catch part is released from the striker, wherein the catch part comprises:

a catch having a locking groove configured to catch or release the striker and a catch gear integrally formed on one side of the catch, the catch and the catch gear fixed together and rotatably installed, and a pawl configured to:

limit a rotation of the catch when in close contact with the catch, allow the catch to be freely rotatable, wherein the door locking and releasing part comprises:

the main motor rotate in a clockwise direction and an anticlockwise direction, the main motor comprising:

a first drive gear, a first driven gear engaged with the first drive gear, a pawl release lever coupled to the pawl and configured to be rotated with the pawl, and an operating lever engaged with the first driven gear and configured to:

receive the torque through the first driven gear, and rotate the pawl release lever in order to bring the pawl in close contact with the catch or to separate it from the catch, wherein the auxiliary motor includes a second drive gear configured to apply the torque to the catch through a gear mechanism of the pop-out part between the second drive gear and the catch gear integrally formed on the catch, and wherein the gear mechanism of the pop-out part comprises:

a second driven gear engaged with the second drive gear, and a third driven gear engaged with the second driven gear and simultaneously engaged with the catch gear of the catch.

8. The vehicle of claim 7, further comprising:

two seating protrusions formed at the pawl release lever; and a pressurizing protrusion provided at the operating lever, wherein the pressurizing protrusion is seated on the seating protrusions and is configured to press and rotate the pawl release lever.

9. The vehicle of claim 8, further comprising a door latch controller configured to detect an operation of a handle or a button installed at the door for the vehicle and to apply an operation signal to the main motor.

10. The vehicle of claim 9, wherein the door latch controller is configured to apply the operation signal to the auxiliary motor after the main motor is operated.

11. The vehicle of claim 7, further comprising a door latch controller configured to detect an operation of a handle or a button installed at the door for the vehicle and to apply an operation signal to the main motor.

12. The vehicle of claim 11, wherein the door latch controller is configured to apply the operation signal to the auxiliary motor after the main motor is operated.

13. A motor-driven door latch for a vehicle having a vehicle body, the motor-driven door latch comprising:

a catch part configured to catch a striker mounted on the vehicle body to lock a door of the vehicle;

a door locking and releasing part including a main motor and configured to apply torque to the catch part through the main motor to allow the catch part to be locked to or released from the striker; and a pop-out part including an auxiliary motor configured to apply torque to the catch part so that a door of the vehicle is popped out from the vehicle body after the catch part is released from the striker, wherein the catch part comprises:

a catch having a locking groove configured to catch or release the striker and a catch gear integrally formed on one side of the catch, the catch and the catch gear fixed together and rotatably movable, and a pawl configured to:

limit a rotation of the catch and to be separated from the catch to, or allow the catch to be freely rotatable, wherein the door locking and releasing part comprises:

the main motor configured to rotate in a clockwise direction and an anticlockwise direction, the main motor comprising:

a first drive gear, a first driven gear engaged with the first drive gear, a pawl release lever coupled to the pawl and configured to be rotated together with the pawl, and an operating lever engaged with the first driven gear and configured to receive the torque through the first driven gear to rotate the pawl release lever, wherein the motor-driven door latch further comprises two seating protrusions formed at the pawl release lever such that the pawl is in close contact with the catch or is separated from the catch, wherein the auxiliary motor includes a second drive gear configured to apply the torque to the catch through a gear mechanism of the pop-out part between the second drive gear and the catch gear integrally formed on the catch, and wherein the gear mechanism of the pop-out part comprises:

a second driven gear engaged with the second drive gear, and a third driven gear engaged with the second driven gear and simultaneously engaged with the catch gear of the catch.

14. The motor-driven door latch of claim 13, wherein the motor-driven door latch further comprises a pressurizing protrusion provided at the operating lever, wherein the pressurizing protrusion is seated on the seating protrusions and is configured to press and rotate the pawl release lever.

15. The motor-driven door latch of claim 14, further comprising a door latch controller configured to detect an operation of a handle or a button installed at the door for the vehicle and to apply an operation signal to the main motor.

16. The motor-driven door latch of claim 15, wherein the door latch controller is configured to apply the operation signal to the auxiliary motor after the main motor is operated.

17. The motor-driven door latch of claim 13, further comprising a door latch controller configured to detect an operation of a handle or a button installed at the door for the vehicle and to apply an operation signal to the main motor.

18. The motor-driven door latch of claim 17, wherein the door latch controller is configured to apply the operation signal to the auxiliary motor after the main motor is operated.

* * * * *